US010827569B2

(12) United States Patent
Grassi et al.

(10) Patent No.: US 10,827,569 B2
(45) Date of Patent: Nov. 3, 2020

(54) CRISPNESS AND BROWNING IN FULL FLAT MICROWAVE OVEN

(71) Applicant: WHIRLPOOL CORPORATION, Benton Harbor, MI (US)

(72) Inventors: Andrea Francesco Grassi, Varese (IT); Vince Huang, Guangdong (CN); Jack Xu, Guangdong (CN); Tingting Yu, Shenzhen (CN)

(73) Assignee: Whirlpool Corporation, Benton Harbor, MI (US)

( * ) Notice: Subject to any disclaimer, the term of this patent is extended or adjusted under 35 U.S.C. 154(b) by 188 days.

(21) Appl. No.: 16/115,986

(22) Filed: Aug. 29, 2018

(65) Prior Publication Data

US 2019/0075624 A1 Mar. 7, 2019

Related U.S. Application Data

(60) Provisional application No. 62/553,476, filed on Sep. 1, 2017.

(51) Int. Cl.

| | |
|---|---|
| ***H05B 6/64*** | (2006.01) |
| ***H05B 6/72*** | (2006.01) |
| ***H05B 6/68*** | (2006.01) |

(52) U.S. Cl.

CPC ..... *H05B 6/6482* (2013.01); *H05B 6/6408* (2013.01); *H05B 6/6491* (2013.01); *H05B 6/6494* (2013.01); *H05B 6/686* (2013.01); *H05B 6/725* (2013.01); *H05B 2206/044* (2013.01)

(58) Field of Classification Search

CPC ..... H05B 6/64–6402; H05B 6/6447; H05B 6/647–6485; H05B 6/6491–6494; H05B 6/72–725

See application file for complete search history.

(56) References Cited

U.S. PATENT DOCUMENTS

| | | | |
|---|---|---|---|
| 2,742,612 | A | 4/1956 | Cohn |
| 2,956,143 | A | 10/1960 | Schall |
| 2,958,754 | A | 11/1960 | Hahn |
| 2,981,904 | A | 4/1961 | Ajioka et al. |
| 3,260,832 | A | 7/1966 | Johnson |
| 3,265,995 | A | 8/1966 | Hamasaki |

(Continued)

FOREIGN PATENT DOCUMENTS

| | | | |
|---|---|---|---|
| CN | 1523293 | A | 8/2004 |
| CN | 101118425 | | 2/2008 |

(Continued)

*Primary Examiner* — Michael A Laflame, Jr.

(74) *Attorney, Agent, or Firm* — Price Heneveld LLP

(57) ABSTRACT

A microwave heating apparatus is disclosed. The heating apparatus comprises a cavity comprising a ceiling and a bottom support plate. The cavity is arranged to receive a food load. The apparatus further comprises at least one microwave supply system configured to supply microwaves at the cavity bottom. The at least one microwave supply system comprises at least one microwave source and at least one antenna arranged below the bottom support plate. The apparatus further comprises a heat element and a crisp plate. The heat element is connected proximate the ceiling and extends substantially over a ceiling area formed by the ceiling. The crisp plate is disposed in the cavity and vertically spaced from the bottom support plate by a rack.

20 Claims, 5 Drawing Sheets

(56) References Cited

U.S. PATENT DOCUMENTS 3,430,023 A 2/1969 Tingley
3,440,385 A 4/1969 Smith
3,489,135 A 1/1970 Astrella
3,536,129 A 10/1970 White
3,639,717 A 2/1972 Mochizuki
3,731,035 A 5/1973 Jarvis et al.
3,737,812 A 6/1973 Gaudio et al.
3,812,316 A 5/1974 Milburn
4,000,390 A 12/1976 Graff
4,088,861 A 5/1978 Zwillinger
D248,607 S 7/1978 Yamamura et al.
4,101,750 A 7/1978 Doner
4,107,502 A 8/1978 Tanaka et al.
4,136,271 A 1/1979 Tanaka et al.
4,139,828 A 2/1979 Commault et al.
4,143,646 A 3/1979 Sampsel et al.
4,166,207 A 8/1979 Burke
4,196,332 A 1/1980 MacKay et al.
4,264,800 A 4/1981 Jahnke et al.
4,283,614 A 8/1981 Tanaka et al.
4,321,445 A 3/1982 Kristof et al.
4,354,562 A 10/1982 Newman
4,374,319 A 2/1983 Guibert
D268,079 S 3/1983 Miyake et al.
4,463,324 A 7/1984 Rolfs
D275,546 S 9/1984 Tanaka et al.
D276,122 S 10/1984 Tanaka et al.
D277,355 S 1/1985 Miyake et al.
4,595,827 A 6/1986 Hirai et al.
D285,893 S 9/1986 Mizuma et al.
4,628,351 A 12/1986 Heo
4,673,800 A 6/1987 Hirai et al.
4,703,151 A 10/1987 Sakamoto
4,743,728 A 5/1988 Nagafusa et al.
D297,698 S 9/1988 Nishikawa et al.
D297,800 S 9/1988 Feil et al.
4,786,774 A 11/1988 Kaminaka
D303,063 S 8/1989 Satake
4,870,238 A 9/1989 Hodgetts et al.
4,886,046 A 12/1989 Welch et al.
4,937,413 A 6/1990 Spruytenburg et al.
4,999,459 A 3/1991 Smith et al.
5,075,525 A 12/1991 Jung
D330,144 S 10/1992 Takebata et al.
5,369,254 A 11/1994 Kwon
D353,511 S 12/1994 Saimen
5,483,045 A 1/1996 Gerling
5,546,927 A 8/1996 Lancelot
5,558,800 A 9/1996 Page
D378,723 S 4/1997 Weiss
5,619,983 A 4/1997 Smith
D385,155 S 10/1997 Weiss et al.
5,726,428 A 3/1998 Christensen
5,735,261 A 4/1998 Kieslinger
5,831,253 A 11/1998 Han et al.
5,978,910 A 3/1999 Gibernau et al.
D411,074 S 6/1999 Sakai et al.
5,919,389 A 7/1999 Uehashi et al.
5,928,540 A 7/1999 Antoine et al.
5,935,477 A * 8/1999 Koochaki ..... H05B 6/6494 219/725
5,973,305 A 10/1999 Kim et al.
5,981,929 A 11/1999 Maeda et al.
6,018,158 A 1/2000 Kang
6,054,696 A 4/2000 Lewis et al.
6,057,535 A 5/2000 Derobert et al.
6,097,019 A 8/2000 Lewis et al.
6,268,593 B1 7/2001 Sakai
6,359,270 B1 3/2002 Bridson
6,429,370 B1 8/2002 Norte et al.
6,557,756 B1 5/2003 Smith
6,559,882 B1 5/2003 Kerchner
D481,582 S 11/2003 Seum et al.
6,664,523 B1 12/2003 Kim et al.
6,696,678 B2 2/2004 Hudson et al.
D495,556 S 9/2004 Milrud et al.
6,853,399 B1 2/2005 Gilman et al.
D521,799 S 5/2006 Ledingham et al.
D522,801 S 6/2006 Lee
D527,572 S 9/2006 Lee et al.
7,105,787 B2 9/2006 Clemen, Jr.
7,111,247 B2 9/2006 Choi et al.
D530,973 S 10/2006 Lee et al.
D531,447 S 11/2006 Lee et al.
D532,645 S 11/2006 Lee
7,193,195 B2 3/2007 Lundstrom et al.
D540,105 S 4/2007 Lee et al.
D540,613 S 4/2007 Jeon
D550,024 S 9/2007 Jeon
7,361,871 B2 4/2008 Cho et al.
D568,675 S 5/2008 Kawata
7,476,828 B2 1/2009 Genua
7,482,562 B2 1/2009 Song et al.
D586,619 S 2/2009 Pino et al.
D587,959 S 3/2009 Hensel
7,556,033 B2 7/2009 Kim
D602,306 S 10/2009 Lavy
7,770,985 B2 8/2010 Davis et al.
D625,557 S 10/2010 Pino et al.
D626,370 S 11/2010 Baek
7,919,735 B2 4/2011 Kiyono et al.
7,926,313 B2 4/2011 Schenki et al.
D638,249 S 5/2011 Ryan et al.
8,074,637 B2 12/2011 Yamauchi
D655,970 S 3/2012 De'Longhi
D658,439 S 5/2012 Curtis et al.
D662,759 S 7/2012 Blacken et al.
D663,156 S 7/2012 Curtis et al.
D670,529 S 11/2012 Hensel
D673,000 S 12/2012 De'Longhi
D673,418 S 1/2013 Lee et al.
D678,711 S 3/2013 Reiner
8,389,916 B2 3/2013 Ben-Shmuel et al.
8,455,803 B2 6/2013 Danzer et al.
8,492,666 B2 7/2013 Bilchinsky et al.
8,530,807 B2 9/2013 Niklasson et al.
8,610,038 B2 12/2013 Hyde et al.
8,745,203 B2 6/2014 McCoy
8,803,051 B2 8/2014 Lee et al.
D717,579 S 11/2014 Gregory et al.
9,040,879 B2 5/2015 Libman et al.
D736,554 S 8/2015 Steiner et al.
D737,620 S 9/2015 Miller et al.
D737,622 S 9/2015 Miller et al.
9,131,543 B2 9/2015 Ben-Shmuel et al.
9,132,408 B2 9/2015 Einziger et al.
9,179,506 B2 11/2015 Sim et al.
9,210,740 B2 12/2015 Libman et al.
9,215,756 B2 12/2015 Bilchinsky et al.
9,351,347 B2 5/2016 Torres et al.
9,374,852 B2 6/2016 Bilchinsky et al.
D769,669 S 10/2016 Kim et al.
9,560,699 B2 1/2017 Zhylkov et al.
9,585,203 B2 2/2017 Sadahira et al.
2005/0162335 A1 7/2005 Ishii
2006/0289526 A1 12/2006 Takizaki et al.
2009/0134155 A1 5/2009 Kim et al.
2010/0176121 A1 7/2010 Nobue et al.
2010/0187224 A1 7/2010 Hyde et al.
2011/0031236 A1 2/2011 Ben-Shmuel et al.
2011/0168699 A1 7/2011 Oomori et al.
2011/0290790 A1 12/2011 Sim et al.
2012/0067872 A1 3/2012 Libman et al.
2012/0103972 A1 5/2012 Okajima
2012/0152939 A1 6/2012 Nobue et al.
2012/0160830 A1 6/2012 Bronstering
2013/0048881 A1 2/2013 Einziger et al.
2013/0080098 A1 3/2013 Hadad et al.
2013/0142923 A1 6/2013 Torres et al.
2013/0156906 A1 6/2013 Raghavan et al.
2013/0168389 A1* 7/2013 Ikeda ..... H05B 6/6402 219/756
2013/0186887 A1 7/2013 Hallgren et al.
2013/0200066 A1 8/2013 Gelbart et al.

(56) References Cited

U.S. PATENT DOCUMENTS

| | | | |
|---|---|---|---|
| 2013/0277353 | A1 | 10/2013 | Joseph et al. |
| 2014/0197161 | A1 | 7/2014 | Dobie |
| 2014/0203012 | A1 | 7/2014 | Corona et al. |
| 2014/0208957 | A1 | 7/2014 | Imai et al. |
| 2014/0277100 | A1 | 9/2014 | Kang |
| 2015/0034632 | A1 | 2/2015 | Brill et al. |
| 2015/0070029 | A1 | 3/2015 | Libman et al. |
| 2015/0136758 | A1 | 5/2015 | Yoshino et al. |
| 2015/0156827 | A1 | 6/2015 | Ibragimov et al. |
| 2015/0173128 | A1 | 6/2015 | Hosokawa et al. |
| 2015/0271877 | A1 | 9/2015 | Johansson |
| 2015/0289324 | A1 | 10/2015 | Rober et al. |
| 2015/0305095 | A1 | 10/2015 | Huang et al. |
| 2015/0334788 | A1 | 11/2015 | Hofmann et al. |
| 2015/0373789 | A1 | 12/2015 | Meusburger et al. |
| 2016/0029442 | A1 | 1/2016 | Houbloss et al. |
| 2016/0088690 | A1 | 3/2016 | Kubo et al. |
| 2016/0119982 | A1 | 4/2016 | Kang et al. |
| 2016/0219656 | A1 | 7/2016 | Hunter, Jr. |
| 2016/0327281 | A1 | 11/2016 | Bhogal et al. |
| 2016/0353528 | A1 | 12/2016 | Bilchinsky et al. |
| 2016/0353529 | A1 | 12/2016 | Omori et al. |
| 2017/0099988 | A1 | 4/2017 | Matloubian et al. |
| 2017/0105572 | A1 | 4/2017 | Matloubian et al. |

FOREIGN PATENT DOCUMENTS

| | | | | |
|---|---|---|---|---|
| CN | 201081287 | Y | 7/2008 | |
| CN | 102012051 | A | 4/2011 | |
| CN | 102620324 | A | 8/2012 | |
| CN | 103156532 | A | 6/2013 | |
| CN | 203025135 | U | 6/2013 | |
| CN | 105042654 | A | 11/2015 | |
| CN | 204987134 | U | 1/2016 | |
| CN | 106103555 | A | 11/2016 | |
| DE | 3238441 | A1 | 4/1984 | |
| DE | 102004002466 | A1 | 8/2005 | |
| DE | 102008042467 | A1 | 4/2010 | |
| EP | 0199264 | A2 | 10/1986 | |
| EP | 0493623 | A1 | 8/1992 | |
| EP | 1193584 | | 3/2002 | |
| EP | 1424874 | A2 | 6/2004 | |
| EP | 1426692 | A2 | 6/2004 | |
| EP | 1471773 | A2 | 10/2004 | |
| EP | 1732359 | A2 | 12/2006 | |
| EP | 1795814 | | 6/2007 | |
| EP | 1970631 | A2 | 9/2008 | |
| EP | 2031938 | A1 | 3/2009 | |
| EP | 2205043 | A1 | 7/2010 | |
| EP | 2230463 | A1 | 9/2010 | |
| EP | 2220913 | B1 | 5/2011 | |
| EP | 2512206 | A1 | 10/2012 | |
| EP | 2405711 | A2 | 11/2012 | |
| EP | 2548480 | A1 | 1/2013 | |
| EP | 2548480 | A1 * | 1/2013 | ..... A47J 36/027 |
| EP | 2618634 | A1 | 7/2013 | |
| EP | 2775794 | A1 | 9/2014 | |
| EP | 2906021 | A1 | 8/2015 | |
| EP | 2393339 BI | | 12/2016 | |
| FR | 2694876 | | 2/1994 | |
| FR | 2766272 | A1 | 1/1999 | |
| FR | 2976651 | A | 12/2012 | |
| GB | 639470 | A | 6/1950 | |
| GB | 1424888 | | 2/1976 | |
| GB | 2158225 | A | 11/1985 | |
| GB | 2193619 | A | 2/1988 | |
| GB | 2330053 | | 4/1999 | |
| GB | 2367196 | A | 3/2002 | |
| JP | S55155120 | A | 12/1980 | |
| JP | 57194296 | U | 12/1982 | |
| JP | 59226497 | A | 12/1984 | |
| JP | H0510527 | A | 1/1993 | |
| JP | H06147492 | A | 5/1994 | |
| JP | 8-171986 | | 7/1996 | |
| JP | 2000304593 | A | 11/2000 | |
| JP | 2008108491 | A | 5/2008 | |
| JP | 2011146143 | A | 7/2011 | |
| JP | 2013073710 | A | 4/2013 | |
| KR | 2050002121 | | 7/2005 | |
| KR | 101359460 | B1 | 2/2014 | |
| KR | 20160093858 | A | 8/2016 | |
| RU | 2122338 | C1 | 11/1998 | |
| RU | 2215380 | C2 | 10/2003 | |
| RU | 2003111214 | A | 11/2004 | |
| RU | 2003122979 | A | 2/2005 | |
| RU | 2008115817 | A | 10/2009 | |
| RU | 2008137844 | A | 3/2010 | |
| WO | 8807805 | A1 | 10/1988 | |
| WO | 0036880 | | 6/2000 | |
| WO | 02065036 | A1 | 8/2002 | |
| WO | 03077601 | A1 | 9/2003 | |
| WO | 2008018466 | A1 | 2/2008 | |
| WO | 2008102360 | A2 | 8/2008 | |
| WO | 2009039521 | A1 | 3/2009 | |
| WO | 2011138680 | A2 | 11/2011 | |
| WO | 2012001523 | A2 | 1/2012 | |
| WO | 2012162072 | | 11/2012 | |
| WO | 2011039961 | A1 | 2/2013 | |
| WO | 2015024177 | A1 | 2/2015 | |
| WO | 2015099648 | A1 | 7/2015 | |
| WO | 2015099650 | A1 | 7/2015 | |
| WO | 2015099651 | A1 | 7/2015 | |
| WO | 2016011481 | A1 | 1/2016 | |
| WO | 2016128088 | A1 | 8/2016 | |
| WO | 2017190792 | A1 | 11/2017 | |

* cited by examiner

CRISPNESS AND BROWNING IN FULL FLAT MICROWAVE OVEN

CROSS-REFERENCE TO RELATED APPLICATION

This application claims priority to and the benefit under 35 U.S.C. § 119(e) of U.S. Provisional Patent Application No. 62/553,476, filed on Sep. 1, 2017, entitled "CRISPNESS AND BROWNING IN FULL FLAT MICROWAVE OVEN," the entire disclosure of which is hereby incorporated herein by reference.

TECHNOLOGICAL FIELD

The present invention relates to the field of microwave heating and, in particular, to a versatile microwave heating apparatus.

BACKGROUND

Microwave heating involves feeding of microwave energy into a cavity. Although the basic function of a microwave oven is to heat food by dielectric heating (i.e., via directly acting microwaves absorbed in the food), microwave ovens have been developed to include additional kinds of cooking capabilities, e.g., a crisp (or browning) function or a grill function, thereby enabling preparation of various types of food items and providing new culinary effects. Such additional kinds of cooking capabilities usually require additional components, such as a browning plate or a grill element. The disclosure provides for an improved microwave system configured to evenly cook a food load.

SUMMARY

In at least one aspect, a microwave heating apparatus is disclosed. The heating apparatus comprises a cavity comprising a ceiling and a bottom support plate. The cavity is arranged to receive a food load. The apparatus further comprises at least one microwave supply system configured to supply microwaves at the cavity bottom. The at least one microwave supply system comprises at least one microwave source and at least one antenna arranged below the bottom support plate. The apparatus further comprises a heat element and a crisp plate. The heat element is connected proximate the ceiling and extends substantially over a ceiling area formed by the ceiling. The crisp plate is disposed in the cavity and vertically spaced from the bottom support plate by a rack. The rack is configured to vertically position the crisp plate above the at least one antenna and below the heat element providing for even browning of the food load.

In another aspect, a method for controlling a microwave heating apparatus is disclosed. The method comprises receiving a food load in a cavity comprising a ceiling and a bottom support plate and supplying microwaves into the cavity via at least one microwave source disposed below the bottom support plate. The method further comprises supplying radiant heat from a heat element proximate the ceiling and vertically spacing a crisp plate in the cavity above the bottom support plate. The method further comprises generating heat in the crisp plate in response to the microwaves. The crisp plate is spaced from the bottom above the at least one microwave source and below the heat element.

In yet another aspect, a microwave heating apparatus is disclosed. The heating apparatus comprises a cavity comprising a ceiling and a bottom support plate, wherein the cavity is arranged to receive a food load. At least one microwave supply system is configured to supply microwaves at the bottom support plate. The at least one microwave supply system comprises at least one microwave source and at least one antenna arranged below the bottom support plate. The at least one antenna is configured to rotate below the bottom support plate. A heat element is connected proximate the ceiling and extends substantially over a ceiling area formed by the ceiling. A crisp plate is disposed in the cavity and vertically spaced from the bottom support plate by a rack. The rack is configured to vertically position the crisp plate above the at least one antenna and below the heat element.

These and other features, advantages, and objects of the present device will be further understood and appreciated by those skilled in the art upon studying the following specification, claims, and appended drawings.

BRIEF DESCRIPTION OF THE DRAWINGS

In the drawings.

The above, as well as additional objects, features, and advantages of the present invention, will be better understood through the following illustrative and non-limiting detailed description of preferred embodiments of the present invention, with reference to the appended drawings, in which.

All the figures are schematic, not necessarily to scale, and generally only show parts which are necessary in order to elucidate the invention, wherein other parts may be omitted or merely suggested.

DETAILED DESCRIPTION OF EMBODIMENTS

Figure 1:
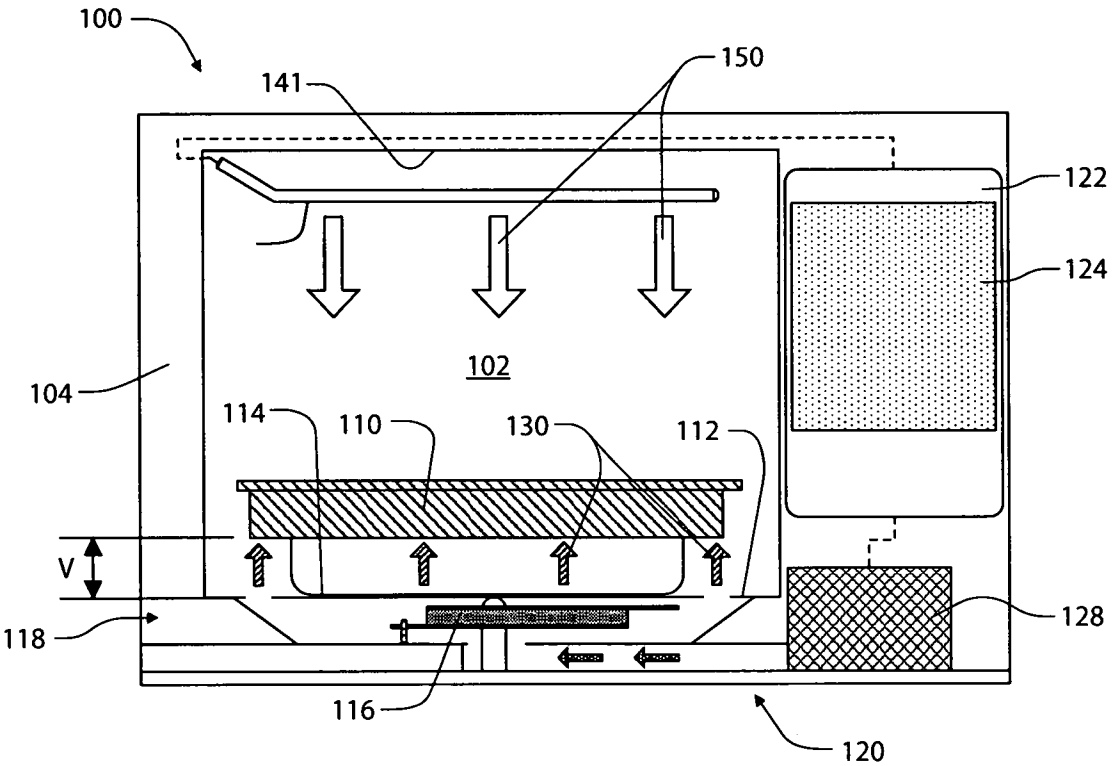
FIG. 1 schematically shows an exemplary embodiment of a microwave heating apparatus according to the disclosure.

For purposes of description herein the terms "upper," "lower," "right," "left," "rear," "front," "vertical," "horizontal," and derivatives thereof shall relate to the device as oriented in FIG. 1. However, it is to be understood that the device may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to the embodiment illustrated in FIG. 1, a microwave heating apparatus 100 is shown having features and functions according to an embodiment of the disclosure. The apparatus 100 comprises a cavity 102 defined by an enclosing surface or external casing 104. The cavity 102 is arranged to receive a food load to be heated. In some embodiments, the microwave may comprise a crisp plate 110, which may be supported and spaced from a support plate 112 via a rack 114. In this configuration, the apparatus 100 may be configured to emit and uniformly radiate electromagnetic energy from at least one antenna 116 disposed in a base portion 118 below the support plate 112.

The rack 114 may be configured to balance a heating operation of the crisp plate 110 and at least one additional heat source (e.g., a grill element). For example, the position of the crisp plate 110 in the cavity 102 may change an intensity or consistency of heating the crisp plate 110 via the electromagnetic radiation or microwave heat energy distributed in the cavity 102. If positioned in some locations or elevations relative to the support plate 112, the crisp plate 110 may form hot spots or cool spots due to inconsistencies in the distribution of the microwave energy. Additionally, the position of the crisp plate 110 as provided by the support plate 112 may cause variations in an intensity of heat delivered to a food load on the crisp plate 110. Accordingly, the disclosure provides for a variety of exemplary embodiments of the apparatus 100 configured to achieve a consistent browning operation based on a distribution of the heat generated by the crisp plate 110 as well as a delivery of heat from one or more additional heat sources.

The microwave cooking apparatus 100 may further comprise a microwave supply system 120 and a control unit 122. The control unit 122 may be configured to control the microwave supply system 120 and may further be in communication with a user interface 124. In operation, the control unit 122 may be configured to control a variety of cooking functions based on inputs received from the user interface 124. For example, the control unit 122 may comprise one or more automated cooking programs that may be activated via the user interface 124 to prepare a food load in the cavity 102.

The user interface 124 may comprise a display or control panel configured to show symbols or plain-text messages for selection of a food category or cooking program and for verification of the selections. Optionally, the display of the user interface 124 may also show a remaining time during a cooking procedure, i.e. provide information on how the cooking or heating proceeds. Additionally, a plurality of user inputs may be incorporated on the user interface 124. The user inputs may be configured to receive information identifying food categories and properties indicating a type and desired doneness of a food load to be heated. In some embodiments, the user interface 124 may comprise a touch screen enabling both entry and display of information.

The microwave supply system 120 comprises at least one microwave source 128 (or a generating block comprising a plurality of microwave sources) configured to supply microwaves to the at least one antenna 116. In this configuration, the microwave supply system 120 may be configured to supply microwaves to the antenna 116 resulting in electromagnetic radiation 130 emitted from the base portion 118 of the cavity 102. The electromagnetic radiation 130 may energize one or more materials of the crisp plate 110 providing for a browning function in the cavity 102. In various embodiments, the at least one antenna 116 may be configured to distribute the electromagnetic radiation 130 over the based portion 118 of the cavity 102 such that the crisp plate 110 is evenly heated. In an exemplary embodiment, the microwave source 128 may be driven by approximately 800-1200 watts.

Figure 2:
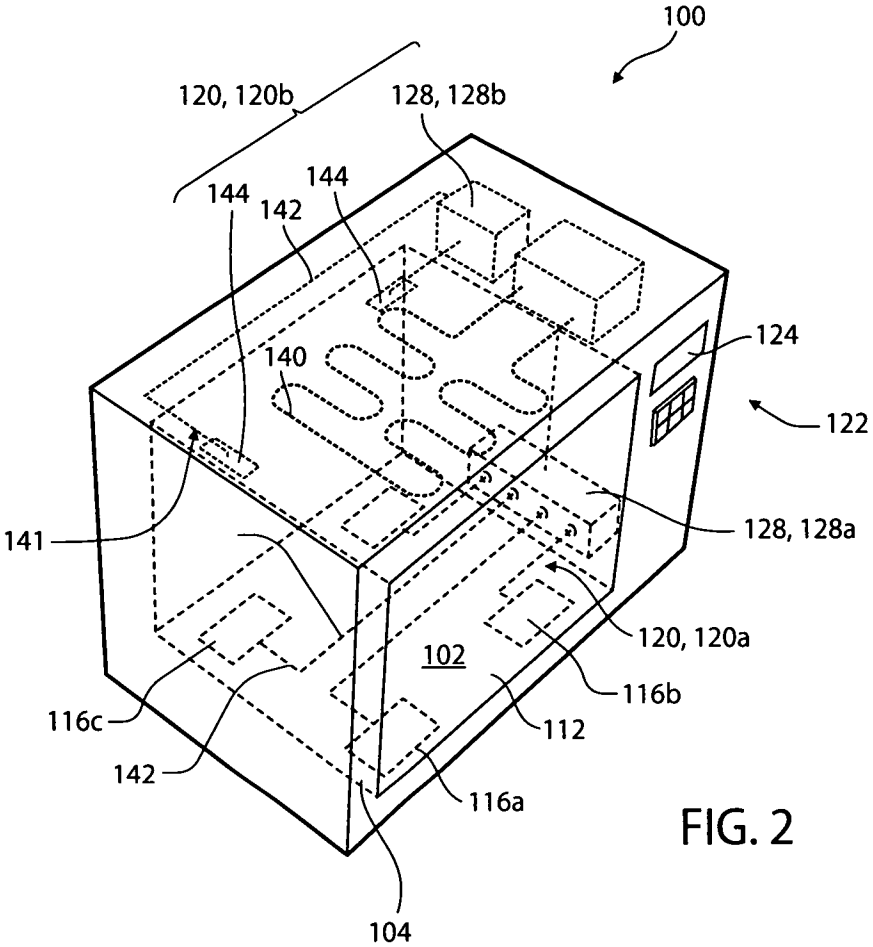
FIG. 2 schematically shows an exemplary embodiment of a microwave heating apparatus according to the disclosure.
Figure 3:
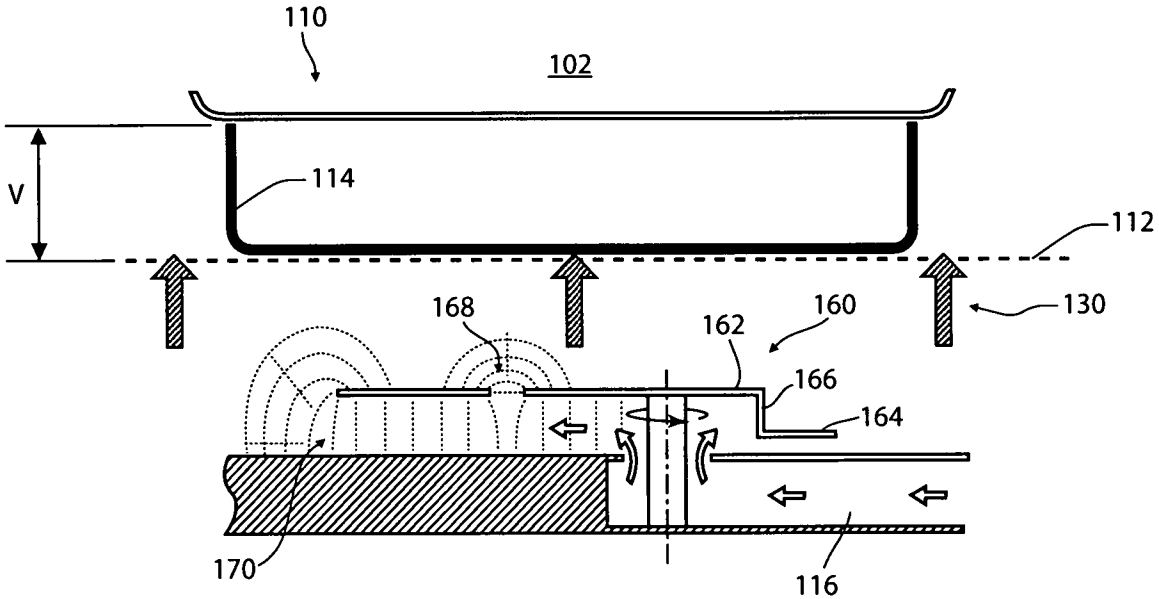
FIG. 3 schematically shows an exemplary embodiment of a microwave antenna according to the disclosure.

In some embodiments, the at least one antenna 116 may be configured to distribute the electromagnetic radiation 130 in the cavity via a stirring operation as further discussed in reference to FIG. 3. For example, the stirring operation may be generated by rotating the at least one antenna 116. Additionally or alternatively, the at least one antenna may comprise a plurality of antennas (e.g., 116*a*, 116*b*, 116*c*, and 116*d*) as discussed in reference to FIG. 2. The plurality of antennas may be configured to distribute and adjust the electromagnetic radiation 130 via one or more solid-state generators configured to adjust a frequency, phase, and power of the electromagnetic radiation 130. In each of the embodiments described herein, the apparatus 100 may provide for even distribution of the electromagnetic radiation 130 to provide for an improved operation of the apparatus 100 in accordance with the disclosure.

FIG. 2 demonstrates an exemplary embodiment of the apparatus 100 comprising the plurality of antennas 116*a*, 116*b*, 116*c*, and 116*d*. Some embodiments of the apparatus 100 may comprise like elements, which are referenced with like reference numerals for clarity. Referring now to FIGS. 1 and 2, in various embodiments, the cooking apparatus 100 may also be equipped with additional heat sources. For example, the apparatus 100 may comprise a grill element 140, a convection heating source, and/or a steam heat source. The additional heat source may increase the cooking capability of the microwave apparatus 100 such that the apparatus may be operable to provide for a balanced browning on a top surface of a food load via the grill element 140 and bottom surface via the crisp plate 110.

The grill element 140 may be arranged proximate a ceiling 141 of the cavity 102. In some embodiments, the grill element 140 may comprise a metallic or steel grill tube, a quartz tube, a halogen-radiation source, or an IR-radiating heater. The grill element 140 may form a plurality of overlapping segments in a serpentine configuration extending substantially over a surface area of the ceiling 141. In this arrangement, the grill element 140 may provide for heat energy 150 to brown or cook a food load to complement the heating of the crisp plate 110. In an exemplary embodiment, the heat power of the grill element 140 may be approximately 1000 w. Additionally, a heat temperature of the grill element 140 may be approximately 700° C.

As previously discussed, the position of the crisp plate 110 within the cavity 102 relative to the at least one antenna 116 and the grill element 140 may be positioned by the rack 114. For example, the vertical spacing V of the crisp plate 110 from the support plate 112 may significantly align a heating or radiation zone of the at least one antenna 116 along with the vertical spacing V of the crisp plate 110. In this configuration, the crisp plate 110 may be positioned to receive a high intensity and consistent distribution of the radiation from the at least one antenna 116. Additionally, the rack 114 may provide for the crisp plate to be advantageously positioned in proximity to the grill element 140. Accordingly, the disclosure may provide for a variety of exemplary embodiments of the apparatus 100 configured to achieve a consistent browning operation based on a distribution of the heat generated by the crisp plate 110 and the grill element 140.

The control unit 122 may be configured to control each of the heat sources, including the microwave supply system 120 and the grill element 140 to achieve even browning and thorough cooking. The control unit may achieve balanced cooking results by controlling the cooking sources (e.g., 120 and 140) to evenly deliver heat energy to the food load in the cavity 102. As previously discussed, the apparatus 100 may comprise the at least one microwave source 128 configured to supply microwaves to the at least one antenna 116. The microwaves generated by the at least one microwave source 128 may be communicated to the plurality of antennas 116 via transmission lines 142 or first transmission lines 142*a*. In this configuration, the microwave source may distribute microwave signals to each of the antennas 116*a*, 116*b*, 116*c*, and 116*d* via the transmission lines 142.

In some embodiment, the apparatus 100 may further comprise an additional or second microwave supply system 120*b*. For clarity, a first microwave supply system 120*a* may comprise a first microwave source 128*a* configured to supply a microwave signal to the antennas 116. The second microwave supply system 120*b* may comprise a second microwave source 128*b* configured to supply a microwave signal to a plurality of feeding ports 144 in the ceiling 141 of the cavity 102. The feeding ports 144 may provide an additional source of heat energy to enter the cavity 102. The microwaves generated by each of the microwave sources 128*a* and 128*b* may be generated by a magnetron or one or more solid-state microwave generators. Each of the microwave feeding ports 144 of the cavity 102 may be connected to the second microwave source 128*b* via the transmission lines 142. In this configuration, the control unit 130 may be configured to independently control the unit 122 of the microwave supply systems 120*a* and 120*b* as well as the grill element 140 to provide an improved cooking operation.

The transmission lines 142 as discussed herein may correspond to waveguides, coaxial cable or a strip line. In some embodiments, conventional waveguides may be used as transmission lines and the corresponding apertures may be of approximately the same size as the waveguide cross-section. However, the transmission lines 142 may be implemented by a variety of arrangements including, but not limited to, E-probes, H-loops, helices, patch antennas and resonant high-ε bodies arranged at the junction between the transmission lines 142 and the cavity 102.

Still referring to FIGS. 1 and 2, in operation, the apparatus 100 may utilize at least one of the microwave supply systems 120*a* and 120*b* in combination with the grill element 140 to improve a cooking operation. For example, the control unit 122 may be configured to regulate the respective power of the first microwave supply system 120*a*, the second microwave supply system 120*b* and/or the grill element 140 on the basis of a cooking program or food category. The cooking program or food category may be selected (or input) via the user interface 124. Based on the entered information, the control unit 122 may access cooking parameters and control algorithms for each of the heat sources 120 and 140 from a memory or a look-up table. In this way, the apparatus 100 may provide for a variety of cooking operations for controlling the microwave supply systems 120 and the grill element 140. The use of a look-up table may be advantageous in that the microwave heating apparatus 100 can itself retrieve the appropriate mode of operation (with details on, e.g., which types of heat source is to be activated, at which power level and for which period of time) based on information entered by a user via the user interface 124 without the need of estimation by the user.

Optionally, the apparatus 100 may also comprise a sensor (not shown) configured to detect if the crisp plate 110 is present in the cavity 102. In such embodiments, the control unit 122 may be configured to activate the first microwave supply system 120*a* in response to a detection of the crisp plate 110. However, depending on the desired cooking program and/or food category, the controller 122 may be configured to selectively activate each of the microwave supply systems 120 in instances when the crisp plate 110 is detected or when the crisp plate 110 is not detected.

As previously discussed, each of the microwave sources 128 may comprise a plurality of microwave generation sources, each comprising a corresponding antenna 116. In an exemplary embodiment, the antennas 116*a*, 116*b*, 116*c*, and 116*d* may be supplied microwave signals by four separate microwave sources. The antennas 116 may be H-loop, patch antennas, various combinations thereof, or similar forms of antennas. The microwave sources 128 may further comprise solid-state based microwave generators. Solid-state generators may control the frequency of the generated microwaves and the output power level of the generator. The frequencies of the microwaves that are emitted from solid-state based generators may constitute a narrow range of frequencies such as 2.4 to 2.5 GHz. However, the present invention is not so limited and could be adapted to emit in a range centered at 915 MHz, for instance 875-955 MHz, or any other suitable range of frequency (or bandwidth). The present invention is for instance applicable for standard sources having mid-band frequencies of 915 MHz, 2450 MHz, 5800 MHz and 22.125 GHz.

Referring now to FIGS. 1 and 3, in some embodiments, the microwave apparatus 100 may be configured to distribute the electromagnetic radiation 130 in the cavity via a stirring operation. The stirring operation is discussed in reference to the at least one antenna 116 disposed in a base portion 118 below the support plate 112. In such embodiments, the at least one antenna 116 may be implemented as a rotatable antenna 160. In FIG. 3, the arrows represent the direction of propagation of the microwaves. As demonstrated, the microwaves are emitted from the right-hand side and propagate in the transmission line 142.

The rotatable antenna 160 comprises a sector-shaped panel 162 with a lateral wing 164 spaced from the sector-shaped panel 162 via a side wall 166. The rotatable antenna 160 comprises a top opening 168 (e.g., a rectangular aperture) at the top of the sector-shaped panel 162 from which microwaves may exit the antenna 160. The rotatable antenna 160 may be designed such that the power of the microwaves emitted from a main opening 170 of the rotatable antenna 160 and the top aperture 126 is balanced and uniformly heats the crisp plate 110.

In various embodiments, the apparatus 100 may comprise the rack 114 configured to support and space the crisp plate 110 from the support plate, which may be supported and spaced from a support plate 112 via a rack 114. For example, the vertical spacing V or spacing of the crisp plate 110 from the support plate 112 may significantly align a heating or radiation zone of the rotating antenna 160 along the vertical spacing V of the crisp plate 110. In this configuration, the apparatus 100 may be configured to emit and uniformly radiate electromagnetic energy from the at least one antenna 116 or rotating antenna 160 disposed in the base portion 118 below the support plate 112. The crisp plate 110 and the rack 114 are further discussed in reference to FIG. 4.

Figure 4:
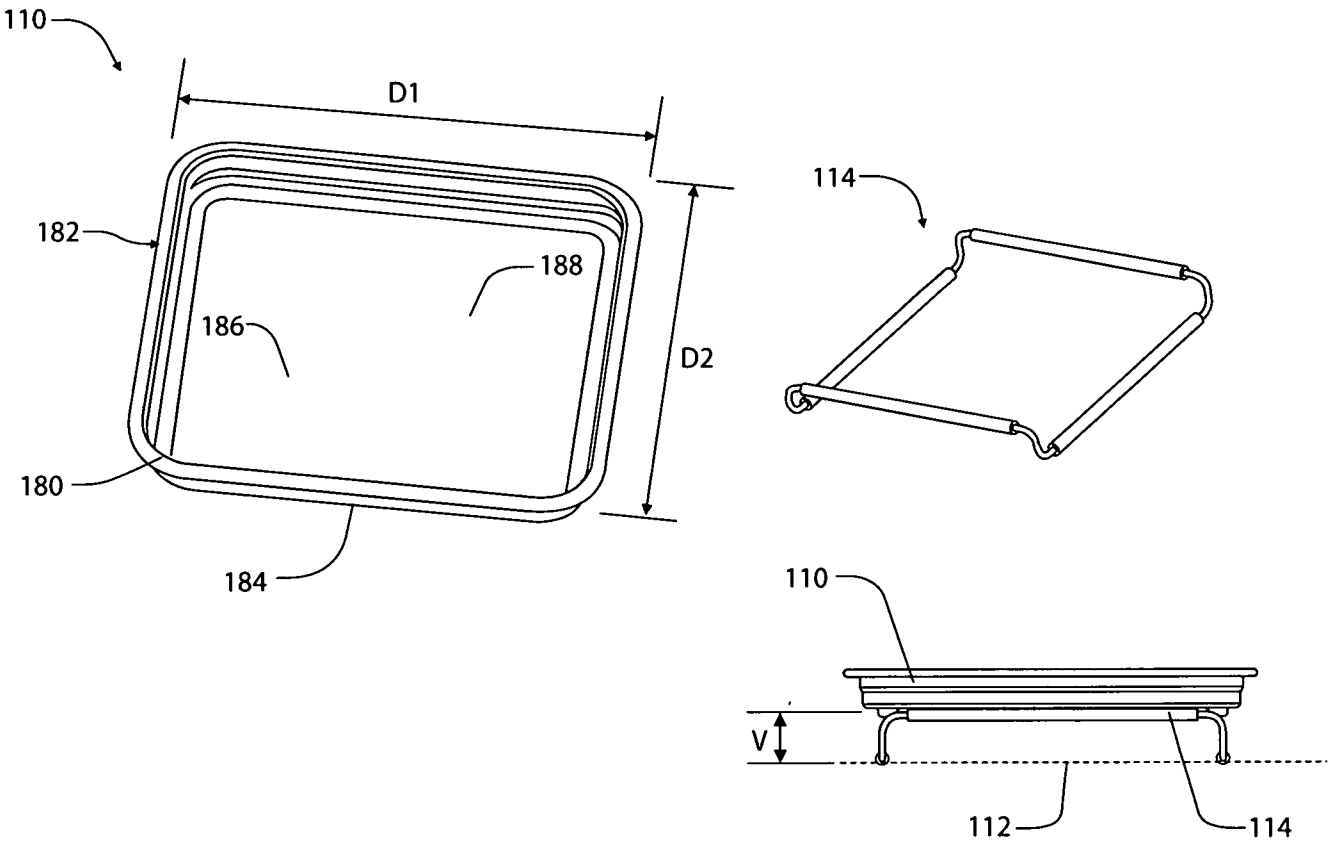
FIG. 4 demonstrates a crisp or browning plate and a rack for use with a microwave heating apparatus according to the disclosure.
Figure 5:
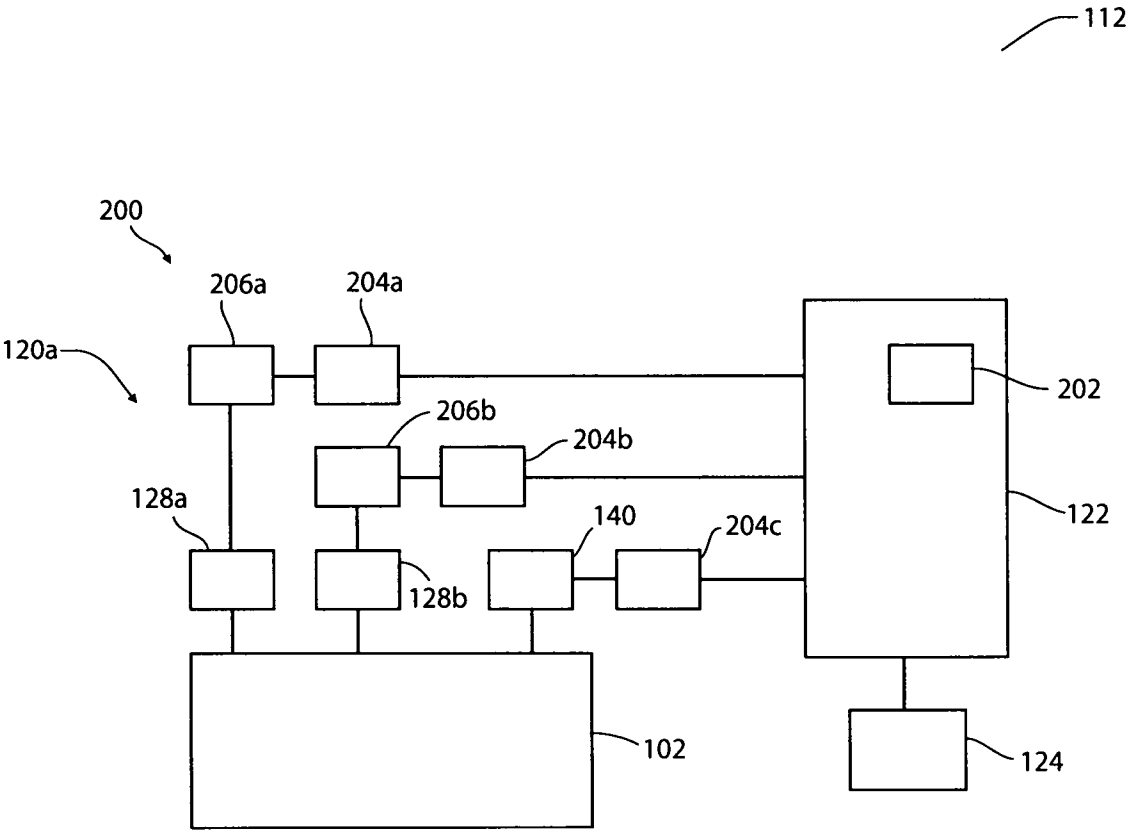
FIG. 5 shows a block diagram illustrating the functional units of a microwave heating apparatus according to the disclosure.

Referring now to FIG. 4, diagrams of the browning or crisp plate 110 and the rack 114 are shown. As previously discussed, the rack 114 may be configured to balance a heating operation of the crisp plate 110 and the grill element 140. For example, if the crisp plate is rested directly on the support plate 112, the bottom of the food load may easily scorch. Additionally, if positioned too high, the grill element 140 may brown a top surface of a food load prior to the crisp plate 110 browning a bottom portion. Accordingly, a balance of the heating power of the microwave source 128 delivered by the at least one antenna 116 and the grill element 140 is needed to ensure even results. To assist in achieving the balanced delivery of heat energy from the heat sources 120 and 140, the rack 114 may locate the crisp plate 110 spacing the crisp plate from the support plate 112. In this way, the rack 114 in combination with the crisp plate 110 and the heat sources 120 and 140 may be configured to supply heat energy to the cavity 102 to achieve balanced cooking results.

In an exemplary embodiment, rack 114 may be configured to provide the vertical spacing V between the crisp plate 110 and the support plate 112 ranging from approximately 40-60 mm. Additionally, an outside perimeter 180 of the crisp plate 110 should be spaced approximately 5-30 mm from the walls of the cavity 102. If the spacing between the perimeter 180 and the walls of the cavity 102 is not maintained, the uniformity of distribution of the electromagnetic radiation 130 in the cavity may be disturbed or split above and below the crisp plate 110.

In order to maintain the spacing a perimeter shape 182 of the crisp plate 110 may also be formed to match a perimeter shape formed by the cavity 102. For example, in the exemplary embodiment shown in FIG. 1, the crisp plate 110 comprises a rectangular or square perimeter shape having dimensions of approximately 26 cm in dimension D1 and 26 cm in dimension D2. Accordingly, the cavity 102 may form a complementary shape or square cavity configured to receive the crisp plate 110 and maintain an edge spacing of approximately 5-30 mm from the walls of the cavity 102. Though the crisp plate 110 and the cavity 102 are discussed having particular dimensions, it shall be understood that the dimensions and relationships of the elements are provided for explanation and should not be considered limiting to the scope of the disclosure.

In various embodiments, the crisp plate 102 may comprise a first layer 184 comprising a microwave-absorbing layer material arranged in thermal contact with a second layer 186 formed of a material having a relatively high level of thermal conductivity. In particular, the antennas 116 may be arranged such that the magnetic field vectors of microwaves fed into the cavity 102 are directed substantially along the first layer 184 in order to generate magnetic losses in the first layer 184 and thereby heat the crisp plate 110. The first layer 184 may form an underside (or the sole) of the crisp plate 110. The second layer 186 may form an upper side of the crisp plate 110 and may consist of an aluminum (or steel) plate. The second layer 186 may have a small thermal mass and good thermal conductivity. In some embodiments, a third layer 188 may further be applied to the second layer 186 in the form of a non-stick coating.

The first layer 184 may be formed of a rubber-embedded ferrite (in a proportion of about 75% ferrite and 25% silicon dioxide). The ferrite material has a Curie point at which absorption of microwaves in the material ceases. The characteristics for absorption of the microwaves in the ferrite material may be varied by altering the thickness of the layer and/or the composition of the material. Generally, the temperature of the second layer 186 or upper side of the crisp plate 110 is the portion that may contact the food load stabilized in a temperature range of 130-230° C.

Referring now to FIG. 3, a block diagram of a system 200 forming the microwave apparatus 100 is shown. In an exemplary embodiment, the control units 122 may comprise a microprocessor and a memory 202 or program store. The memory 202 may be configured to store a look-up table comprising preprogrammed operation modes and parameters as discussed herein. Information about food category and cooking program may be inputted via the user interface 124, which may comprise a touch screen, display, control buttons, and/or a control knob. The determination of the operation mode by the control unit 122 may be realized by means of algorithms accessed via the memory 202 that optimize, or at least improve, the balance between different energy sources, for example the balance between microwave heating via the crisp function at the bottom of the cavity and standard microwave heating via the feeding ports at the ceiling of the cavity.

The control unit 122 may be configured to control the first microwave source **128*a* via a first driver 204*a* and a first microwave power unit 206*a* of the second microwave supply system 120*b*. Similarly, the control unit 122 may be configured to control the second microwave source 128*b* via a second driver 204*b* and a second microwave power unit 206*b* of the first microwave supply system 120*a*. Further, the controller 122 may be configured to control the grill element 140 via a third driver 204*c*. In this configuration, the control unit 122 may be configured to control each of the microwave supply systems 120 as well as the grill element 140 to provide even browning results in the microwave cavity 102**.

While specific embodiments have been described, the skilled person will understand that various modifications and alterations are conceivable within the scope as defined in the appended claims.

It will be understood by one having ordinary skill in the art that construction of the described device and other components is not limited to any specific material. Other exemplary embodiments of the device disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the device as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present device. The exemplary structures and processes disclosed herein are for illustrative purposes and are not to be construed as limiting.

It is also to be understood that variations and modifications can be made on the aforementioned structures and methods without departing from the concepts of the present device, and further it is to be understood that such concepts are intended to be covered by the following claims unless these claims by their language expressly state otherwise.

The above description is considered that of the illustrated embodiments only. Modifications of the device will occur to those skilled in the art and to those who make or use the device. Therefore, it is understood that the embodiments shown in the drawings and described above is merely for illustrative purposes and not intended to limit the scope of the device, which is defined by the following claims as interpreted according to the principles of patent law, including the Doctrine of Equivalents.

What is claimed is:

1. A microwave heating apparatus comprising:

a cavity comprising a ceiling and a bottom support plate, wherein the cavity is arranged to receive a food load;

at least one microwave supply system configured to supply microwaves at the bottom support plate, wherein the at least one microwave supply system comprises at least one microwave source and at least one antenna arranged below the bottom support plate;

a heat element connected proximate the ceiling and extending substantially over a ceiling area formed by the ceiling; and a crisp plate disposed in the cavity and vertically spaced from the bottom support plate by a rack, wherein the crisp plate is vertically spaced by a distance between 40 and 60 mm from the bottom support plate.

2. The microwave heating apparatus according to claim 1, wherein the rack is configured to vertically position the crisp plate above the at least one antenna and below the heat element.

3. The microwave heating apparatus according to claim 1, wherein the antenna corresponds to a rotating antenna configured to rotate below the bottom support plate.

4. The microwave heating apparatus according to claim 3, wherein the rotating antenna comprises a lateral wing configured to rotate about a sector shaped panel.

5. The microwave heating apparatus according to claim 3, wherein the rotating antenna is configured to evenly distribute electromagnetic radiation in the cavity.

6. The microwave heating apparatus according to claim 1, wherein the rack is configured to position the crisp plate aligned with a radiation zone above the bottom support plate.

7. The microwave heating apparatus according to claim 6, wherein the rack is further configured to adjust the crisp plate at a proximity to the grill element such that the food load is browned consistently over a top surface and a bottom surface.

8. The microwave heating apparatus according to claim 1, wherein the heat element corresponds to a grill element formed by a steel grill tube.

9. The microwave heating apparatus according to claim 1, wherein the at least one microwave supply system comprises a first microwave source below the bottom support plate and a second microwave source configured to supply microwave energy via feeding ports in the ceiling of the cavity.

10. The microwave heating apparatus according to claim 1, wherein the crisp plate comprises a first layer comprising a microwave absorbing material and a second layer comprising a thermally conductive material configured to conduct heat energy from the first layer.

11. The microwave heating apparatus according to claim 10, wherein the microwave absorbing material comprises rubber-embedded ferrite.

12. A method for controlling a microwave heating apparatus comprising:

receiving a food load in a cavity comprising a ceiling and a bottom support plate, supplying microwaves into the cavity via at least one microwave source disposed below the bottom support plate;

supplying radiant heat from a heat element proximate the ceiling;

vertically spacing a crisp plate in the cavity above the bottom support plate by a distance between 40 and 60 mm from the bottom support plate; and generating heat in the crisp plate in response to the microwaves, wherein the crisp plate is spaced from the bottom above the at least one microwave source and below the heat element.

13. The method according to claim 12, wherein supplying microwaves into the cavity comprises rotating an antenna below the bottom support plate.

14. The method according to claim 13, wherein the rotating distributes the microwaves in the cavity evenly from below the bottom support plate.

15. The method according to claim 12, wherein the supplying the microwave from the least one microwave source comprises supplying the microwaves from the first microwave source disposed below the bottom support plate and supplying the microwaves from a second microwave source configured to supply microwave energy via feeding ports in the ceiling of the cavity.

16. The method according to claim 12, wherein generating heat in the crisp plate comprises absorbing the microwaves in a first layer of the crisp plate and conducting heat from the first layer into a second layer of the crisp plate.

17. A microwave heating apparatus comprising:

a cavity comprising a ceiling and a bottom support plate, wherein the cavity is arranged to receive a food load;

at least one microwave supply system configured to supply microwaves at the bottom support plate, wherein the at least one microwave supply system comprises at least one microwave source and at least one antenna arranged below the bottom support plate, wherein the at least one antenna is configured to rotate below the bottom support plate;

a heat element connected proximate the ceiling and extending substantially over a ceiling area formed by the ceiling; and a crisp plate disposed in the cavity and vertically spaced from the bottom support plate by a rack, wherein the rack is configured to vertically position the crisp plate above the at least one antenna and below the heat element and position the crisp plate aligned with a radiation zone between 40 and 60 mm above the bottom support plate.

18. The microwave heating apparatus according to claim 17, wherein the at least one antenna comprises a lateral wing configured to rotate about a sector shaped panel evenly distributing electromagnetic radiation in the cavity.

19. The microwave heating apparatus according to claim 1, wherein the cavity comprises a perimeter wall, and wherein an outside perimeter of the crisp plate is proportioned to maintain a horizontal spacing between 5 and 30 mm from the perimeter wall of the cavity.

20. The microwave heating apparatus according to claim 19, wherein the horizontal spacing is configured to limit a split in the microwaves from the at least one microwave supply system above and below the crisp plate.

* * * * *